US008807286B2

(12) United States Patent
Puranen et al.

(10) Patent No.: US 8,807,286 B2
(45) Date of Patent: Aug. 19, 2014

(54) METHOD AND AN ARRANGEMENT IN ROPE CONDITION MONITORING OF AN ELEVATOR

(71) Applicant: KONE Corporation, Helsinki (FI)

(72) Inventors: Mikko Puranen, Helsinki (FI); Riku Lampinen, Helsinki (FI); Antti Saarelainen, Espoo (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 14/143,566

(22) Filed: Dec. 30, 2013

(65) Prior Publication Data

US 2014/0182974 A1 Jul. 3, 2014

(30) Foreign Application Priority Data

Dec. 30, 2012 (FI) ..... 20126392

(51) Int. Cl.
*B66B 1/34* (2006.01)

(52) U.S. Cl.
USPC ..... 187/391; 73/158; 324/693

(58) Field of Classification Search
USPC ..... 187/391, 393, 394; 73/381, 391, 473, 73/158; 324/522, 523, 525, 691, 693
See application file for complete search history.

(56) References Cited

U.S. PATENT DOCUMENTS

| | | | | |
|---|---|---|---|---|
| 6,073,728 | A * | 6/2000 | Olsen et al. | 187/414 |
| 6,123,176 | A * | 9/2000 | O'Donnell et al. | 187/393 |
| 6,325,179 | B1 * | 12/2001 | Barreiro et al. | 187/393 |
| 7,123,030 | B2 * | 10/2006 | Robar et al. | 324/693 |
| 8,011,479 | B2 * | 9/2011 | Stucky et al. | 187/393 |
| 8,162,110 | B2 * | 4/2012 | Smith et al. | 187/393 |
| 8,424,653 | B2 * | 4/2013 | Stucky et al. | 187/393 |
| 8,686,747 | B2 * | 4/2014 | Berner et al. | 324/691 |
| 2001/0040039 | A1 | 11/2001 | De Angelis | |
| 2003/0121729 | A1 | 7/2003 | Heinz et al. | |
| 2013/0048432 | A1 * | 2/2013 | Alasentie | 187/251 |
| 2013/0207668 | A1 | 8/2013 | Fargo et al. | |

FOREIGN PATENT DOCUMENTS

| | | | |
|---|---|---|---|
| EP | 1 357 073 | A1 | 10/2003 |
| JP | 8-53274 | A | 2/1996 |
| JP | 10-139312 | A | 5/1998 |
| JP | 2009-249117 | A | 10/2009 |
| JP | 2011-509899 | A | 3/2011 |
| WO | WO 02/46082 | A1 | 6/2002 |
| WO | WO 2009/090299 | A1 | 7/2009 |
| WO | WO 2011/004071 | A2 | 1/2011 |
| WO | WO 2012/030332 | A1 | 3/2012 |
| WO | WO 2013/151525 | A1 | 10/2013 |

* cited by examiner

*Primary Examiner* — Anthony Salata
(74) *Attorney, Agent, or Firm* — Birch, Stewart, Kolasch & Birch, LLP

(57) ABSTRACT

The invention relates to a method in rope condition monitoring of an elevator, in which method at least the following steps are performed: electrical resistance between a first point and a second point of elevator suspension and/or transmission ropes is measured first time, a threshold value is determined based on the measurement, the elevator is used for transporting passengers and/or goods, electrical resistance between the first point and the second point of said suspension and/or transmission ropes is measured second time, and results of said second time measurement are compared with said threshold value, and if said second time measurement meets said threshold value, predetermined actions are carried out. The invention also relates to an arrangement in rope condition monitoring of an elevator.

20 Claims, 2 Drawing Sheets

METHOD AND AN ARRANGEMENT IN ROPE CONDITION MONITORING OF AN ELEVATOR

FIELD OF THE INVENTION

The object of the invention is a method and an arrangement in rope condition monitoring of an elevator, the elevator being suitable for transporting passengers and/or goods.

BACKGROUND OF THE INVENTION

In elevator systems, suspension and transmission ropes are used for supporting and/or moving an elevator car, a counterweight or both. Elevator ropes are generally made by braiding from metallic wires or filaments and have a substantially round cross-sectional shape. A problem with metallic ropes is, due to the material properties of metal, that they have high weight and large thickness in relation to their tensile stiffness and tensile strength.

Also light-weight suspension and transmission ropes, where the width of the rope for a hoisting machine is larger than its thickness in a transverse direction of the rope, are known. The rope comprises a load-bearing part made of composite materials, which composite materials comprise non-metallic reinforcing fibers in polymer matrix material. The structure and choice of material make it possible to achieve low-weight suspension and/or transmission ropes having a thin construction in the bending direction, a good tensile stiffness and tensile strength. In addition, the rope structure remains substantially unchanged at bending, which contributes towards a long service life.

Several mechanical and electrical methods have been presented to provide a tool for condition monitoring of elevator suspension and transmission ropes. For instance, a method for monitoring condition of steel strands wound into a cord and encased in a jacket within a belt in an elevator system is known from prior art. The development of non-destructive controls allowing damage detection in fibre-reinforced polymers during service life is a key problem in many practical applications also in elevator technology. Many of these non-destructive tests involve the periodic inspection of composite components by means of costly equipment. Furthermore, the problem in using testing of electrical properties of the rope is that the initial values vary in each rope and might be different after installation ropes in the elevator. There is thus a growing need for cost effective and reliable condition monitoring methods of elevator ropes which integrate sensors allowing the in situ monitoring of damage throughout the elevator life.

BRIEF DESCRIPTION OF THE INVENTION

The object of the invention is to introduce an improved method and arrangement in rope condition monitoring of an elevator. The object of the invention is, inter alia, to solve drawbacks of known solutions and problems discussed later in the description of the invention. It is also an object to allow a cost-effective and reliable condition monitoring arrangement and method of an elevator suspension and/or transmission rope comprising composite materials allowing the in situ monitoring of damage throughout the elevator life.

Embodiments are presented which, inter alia, facilitate simple, safe and efficient damage detection of non-metallic, preferably carbon-fibre-reinforced polymer composite load bearing parts in said elevator ropes. Also, embodiments are presented, where access to the condition monitoring means is good and safe working position and good ergonomics can be ensured. Also, embodiments are presented, where reliable in situ condition monitoring of the ropes throughout the elevator life is possible and safety of the elevator is improved.

It is brought forward a new method and arrangement in rope condition monitoring of non-metallic light-weight ropes of an elevator. In a preferred embodiment electrical resistance between a first point and a second point of elevator suspension and/or transmission rope is measured first time, and thereafter a threshold value is determined based on the measurement, and thereafter the elevator is used for transporting passengers and/or goods, and thereafter electrical resistance between the first point and the second point of said suspension and/or transmission ropes is measured second time, and thereafter results of said second time measurement are compared with said threshold value, and if said second time measurement meets said threshold value, predetermined actions are carried out.

In a preferred embodiment, electrical resistance between the first point and the second point of said suspension and/or transmission ropes is measured first time before the elevator is taken into use for transporting passengers and/or goods or during elevator installation.

In a preferred embodiment, the elevator car is suspended on said ropes while said first time and said second time measurements are performed on said ropes.

In a preferred embodiment, said first point and second point are points of a non-metallic load bearing part of the suspension and/or transmission rope, or points of several electrically connected non-metallic load bearing parts of the suspension and/or transmission ropes. Advantageously, said first point and second point are points of load bearing parts of said suspension and/or transmission ropes made of fiber-reinforced polymer matrix composite material, such as carbon fiber-reinforced polymer matrix composite, preferably unidirectional carbon fiber-reinforced polymer matrix composite.

In a preferred embodiment, if said second time measurement value meets said threshold value between a first point and a second point of elevator suspension and/or transmission ropes, an error signal is given by rope condition monitoring means. Advantageously, rope identification code and error level indication are shown for each rope on the LED or LCD display of a rope condition monitoring device of rope condition monitoring means if said error signal is given. Error signals are routed to the elevator controller so that the elevator operation is altered or the elevator is taken out of service. Rope condition monitoring means monitors the status of each rope, said threshold value and said measurement values at predefined time intervals, preferably once per second.

In a preferred embodiment, carbon-fiber-reinforced polymer composite load bearing parts are repeatedly bent and the electrical resistance of the parts is measured. A correlation between the increase in the electrical resistance and the decrease in the bending modulus can be observed. For unidirectional carbon-fiber-reinforced polymer composites, the longitudinal electrical resistance of unidirectional fiber is much lower than the transverse resistance, and the damage in the composite material can be detected by measuring the one or the other. Electrical resistance is a good damage sensor for carbon/epoxy laminates, for instance, especially for the detection of fiber breakage.

In a preferred embodiment there are three distinctive phases in the electrical resistance change. First, the electrical resistance increases slightly when the stress increases. This is normal aging process. When the stress further increases, individual fibers in carbon-fibre-reinforced polymer begin to crack and the electrical resistance will increase a lot faster, causing the change in the slope of the stress-electrical resistance curve. When the fibers fail completely, the electrical resistance increases rapidly.

In a preferred embodiment a DC measurement method measuring electrical resistance, is used. The DC measurement method is mainly sensitive to fiber failures, while AC measurements measuring electrical capacitance provide information on the development of inter-layer matrix cracks and inter-layer delamination. Therefore, with unidirectional fiber composites, such as within load bearing parts of light-weight elevator ropes, electrical resistance measurement method provides more useful information in light of the safe use of the elevator suspension and/or transmission ropes.

In a preferred embodiment, unidirectional carbon-fibre-reinforced polymer is used as a load carrying element instead of steel in a light-weight elevator suspension and/or transmission rope. According to the invention, condition monitoring arrangement and method for ropes with load-bearing parts made of carbon-fibre-reinforced polymer composite has been developed. Electrical resistance is a good indicator for the overall condition of carbon-fibre-reinforced polymer composite. Resistance changes if strain of the fibre is increased or if fibre breaks occur. Resistance change in an elevator rope can be used to detect rope wear or damage.

In a preferred embodiment the rope condition monitoring arrangement is used in elevators with counterweight, however as well being applicable in elevators without counterweight. In addition, it can also be used in conjunction with other hoisting machines, e.g. as a crane suspension and/or transmission rope. The low weight of the rope provides an advantage especially in acceleration situations, because the energy required by changes in the speed of the rope depends on its mass. The low weight further provides an advantage in rope systems requiring separate compensating ropes, because the need for compensating ropes is reduced or eliminated altogether. The low weight also allows easier handling of the ropes.

In a preferred embodiment condition monitoring means comprises condition monitoring device comprising independent adjustable constant current supplies for each rope. In a learning phase, measurement current is adjusted to achieve desired voltage over the rope, advantageously 2.5 V, for instance. Learning sequence is activated only once, immediately after commissioning of the elevator. When the measurement current is adjusted and set, the voltage over the rope is measured through the lifetime of the rope so possible voltage changes, i.e., resistance changes are detected. Initial values of current and voltage are saved in a non-volatile memory. In a preferred embodiment one condition monitoring device is able to monitor multiple, up to twelve, or even more, ropes.

In a preferred embodiment condition monitoring device can identify several, preferably at least three different faults. Normal rope wear causes minor, preferably 2-5% change in resistance. Broken rope coating or slack rope causes preferably low resistance, and breaks in carbon-fibre-reinforced polymer or loose measurement wire causes preferably high resistance.

In a preferred embodiment, said rope condition monitoring device is used to measure resistance changes of the rope during the use of the elevator. Preferably resistance of the rope increases when the strain of the rope increases. Resistance change is reversible if fibre breaks do not occur, irreversible resistance change preferably indicates rope damage and fibre breaks. Bad measuring wire contact increases resistance fluctuation. This may cause some false alarms, but from safety point of view, this is on the safe side.

The filtered results are compared to the threshold values and if said filtered results meet said threshold values, an error code as follows.

Level 1: Minor error, if deviation from said threshold values less than 5%.

Level 2: Low resistance, if deviation from said threshold values is equal to or less than 20%: Rope coating is worn or broken and rope grounded via traction wheel.

Level 3: High resistance, if deviation from the threshold values is over 20%: Rope load-bearing part is broken or measurement wires disconnected.

In a preferred embodiment error signals are routed to the elevator controller so that the elevator operation can be altered or the elevator can be taken out of service, depending on the severity of the fault. Hence the safety of the elevator is improved.

In a preferred embodiment rope pulleys with diameters 750 mm are used, however, even smaller pulleys, preferably with diameters 540 mm or 250 mm can be used with said elevator rope.

In a preferred embodiment the elevator comprises a light-weight rope comprising one or more, preferably at least four unidirectional carbon fiber-reinforced-polymer load-bearing parts covered with polyurethane coating. In case of four load-bearing parts, the rope can be electrically modeled as four resistors. Preferred solution is to measure one rope as a single resistance. In that way measuring arrangements are kept simple and the method is also more reliable, because the number of wires and connections is minimized. This method requires simple and reliable solutions to a) short-circuit carbon fiber-reinforced-polymer load-bearing parts and b) connect the measuring wires to the rope, preferably by self-tapping screws screwed between the load-bearing parts in such way, that the screw acts as an electrically conductive path between adjacent load-bearing parts. At the counter-weight end, three screws are preferably used to short-circuit all of the strands. At the car end, two outermost strands are preferably connected together, and measuring wires are inserted under these two screws with a split ring connector. With this arrangement, all carbon fiber-reinforced-polymer load-bearing parts are monitored and the whole rope is seen as a single resistor.

In a preferred embodiment the monitoring device is based on a microcontroller. The resistance can not be measured directly but a constant current source and voltage measurement are used instead.

In a preferred embodiment the device has numeric display and several, preferably at least four LEDs that are used as a status display and an output and memory card socket for data logging.

In a preferred embodiment one device can monitor several ropes, preferably up to twelve ropes, or even more. In a preferred embodiment current so urce is controlled by a digital to analog-converter DAC. Preferably the DAC driven by the microcontroller provides a reference voltage to the operational amplifier, which in turn adjusts the gate voltage of the MOS-transistor. Preferably gate voltage determines the current that flows through the MOS-transistor. Preferably feedback from the shunt resistor to the operational amplifier ensures that the voltage at the reference point is the same as the control voltage from the DAC. RC-filters are used to prevent oscillations.

In a preferred embodiment the DAC used has several, preferably at least twelve, or even more output sources. To avoid drifting and interference caused by fluctuating operating voltage, reference voltage for shunt resistor and DAC must come preferably from the same point. This totally eliminates the changes in the measurement current fed to the ropes caused by possibly poorly regulated operating voltage.

The elevator as describe anywhere above is preferably, but not necessarily, installed inside a building. The car is preferably traveling vertically. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following the present invention will be described in more detail by way of example and with reference to the attached drawings, in which.

DETAILED DESCRIPTION

Figure 1:
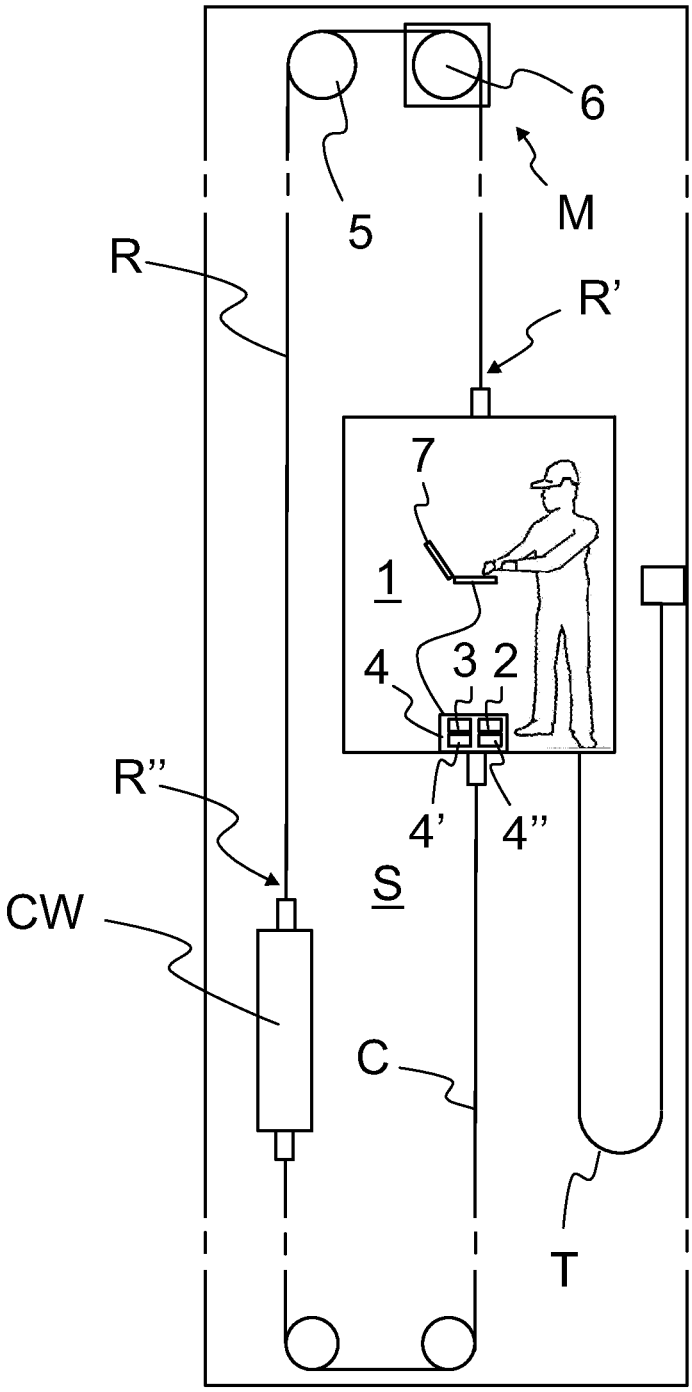
FIG. 1 illustrates an overview of the rope condition monitoring arrangement of an elevator according to an embodiment of the invention where method steps of the invention can be performed.

In FIG. 1 it is illustrated a preferred embodiment where the elevator rope condition monitoring arrangement has been arranged to comprise a hoistway S, and an elevator unit 1 movable in the hoistway S, the elevator unit being an elevator car 1 for transporting passengers and/or goods. The elevator rope condition monitoring arrangement may also comprise additionally other movable elevator units such as the counterweight CW, as depicted. The elevator rope condition monitoring arrangement comprises lifting means comprising a lifting device M, one or more suspension and/or transmission ropes R, each said rope comprising at least four load bearing parts 8*a*, 8*b*, 8*c*, 8*d* connected at least to one elevator unit 1, CW. Rope condition monitoring means comprise connector means, such as screws connected to load bearing parts 8*a*, 8*b*, 8*c*, 8*d* of said ropes R at a first point R' and at a second point R" of said ropes R, a rope condition monitoring device 4 comprising a current source 4', a voltage measurement device 4", a microcontroller 3, and a display 2 for monitoring condition of said ropes R. If the data in the rope condition monitoring means needs to be logged, it can be done with a computer 7 connected to the rope condition monitoring means.

In a preferred embodiment elevator ropes R are guided to pass over the traction sheave 6 rotated by the hoisting machine M of the elevator and one or more diverting pulleys 5. As the hoisting machine M rotates, the traction sheave 6 at the same time moves the elevator car 1 and the counterweight CW in the up direction and down direction, respectively, due to friction. In addition, in high-rise buildings and in high-speed elevators there is a compensating rope C, formed from one or more parallel ropes, which is fixed at its first end to the bottom end of the counterweight CW and at its second end to the bottom part of the elevator car 1, either to the car sling or to the car itself. The compensating rope C is kept taut, e.g. by means of compensating pulleys, under which the compensating rope C passes around and which pulleys are connected to a support structure on the base of the elevator hoistway S, which support structure is not, however, shown in the figure. A travelling cable T intended for the electricity supply of the elevator car and/or for data traffic is fixed at its first end to the elevator car 1, e.g. to the bottom part of the elevator car 1, and at its second end to a connection point on the wall of the elevator hoistway, which connection point is typically at the point of the midpoint or above the midpoint of the height direction of the elevator hoistway.

In a preferred embodiment voltage across the rope R is measured by the microcontroller 3 from the measurement point R". The analog to digital-converter ADC of the microcontroller 3 has preferably a resolution of twelve bits. The reference voltage of the ADC is the same as that of used in current source, again to eliminate the effect of operating voltage fluctuations. Since the current source 4' provides stable measurement current, changes in the rope resistance cause change in the measured voltage.

In a preferred embodiment said rope condition monitoring device 4 has two operating modes, a learning mode and a monitoring mode. The learning mode is started with a four seconds long push of a button located on the printed circuit board PCB of said rope condition monitoring device 4. In this mode, at least the following operations are done.

a) Non-volatile memory of the microcontroller 3, containing the number of connected ropes R, the control value of each current source and the voltage measurement result for each rope R, is erased.

b) Starting from monitoring channel 1 current source is adjusted in such a way that current flowing through the measured rope R increases and the voltage is measured at the same time. When the voltage across the rope is over a limit value, preferably 2.5 V or half of the operating/reference voltage, the current adjustment is stopped, and present current value and measured voltage value as well as the threshold values are stored in non-volatile memory. The number of ropes R, also stored in non-volatile memory, is increased by one, if there is a rope connected to that channel. These steps are repeated for each of the channels, preferably for each of said channels.

c) When the learning sequence is completed, said rope monitoring device 4 continues operation in the monitoring mode.

In a preferred embodiment, the voltage across each rope R is measured in the monitoring mode. The measuring rate is preferably ca. 1200 l/s. Interference is avoided by calculating the floating average of the last results. The filtered results are compared to the threshold values in non-volatile memory, and if said filtered results meet said threshold values, an error code as follows and predetermined actions are carried out.

Level 1: Minor error, if deviation from said threshold values less than 5%.

Level 2: Low resistance, if deviation from said threshold values is equal to or less than 20%: Rope coating is worn or broken and rope grounded via traction wheel.

Level 3: High resistance, if deviation from the threshold values is over 20%: Rope load-bearing part is broken or measurement wires disconnected.

In a preferred embodiment, each error level has its own indicator LED on the display 2 of the rope condition monitoring device 4. Rope number is shown on the LED display 2, and the status of that rope is indicated by the error LEDs at the same time. Preferably error codes are stored in the memory, but they can be erased by resetting said rope condition monitoring device 4.

In a preferred embodiment, error signals are routed to the elevator controller so that the elevator operation can be altered or the elevator can be taken out of service, depending on the severity of the fault.

In a preferred embodiment, after power is set on rope condition monitoring device 4 first sets the current for each measurement channel after reading the respective values from the non-volatile memory. Then it starts operating in the monitoring mode. Said rope condition monitoring device 4 is reset by pressing the button on the PCB and longer push starts the learning sequence.

In a preferred embodiment, if said rope condition monitoring device 4 needs to be replaced, the microcontroller 3 can be removed from its socket and installed in the new device. This way the initial values saved in the no n-volatile memory can still be used and the monitoring can continue without losing the history data. If the data needs to be logged, it can be done with a computer 7 connected to the rope condition monitoring device 4. Said rope condition monitoring device 4 preferably transmits the status of each rope R, the initial resistance value and the current resistance value once per second to the elevator controller.

Figure 2:
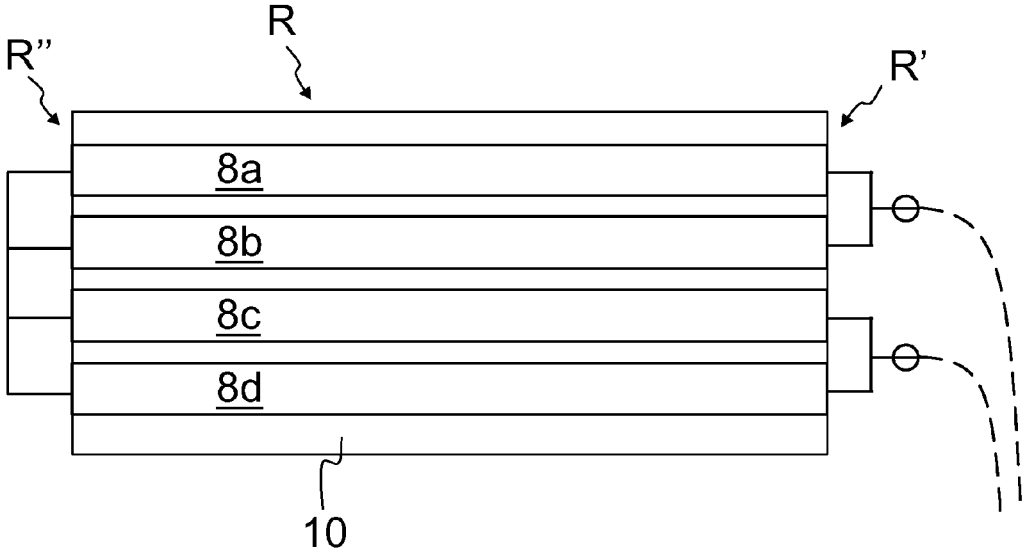
FIG. 2 illustrates an electrical model of the elevator rope condition monitoring arrangement according to an embodiment of the invention.

FIG. 2 illustrates a preferred embodiment of an electrical model of the elevator rope condition monitoring arrangement, especially for the rope R part of said rope condition monitoring means. In a preferred embodiment of the rope condition monitoring arrangement the elevator comprises a light-weight rope R comprising one or more, preferably at least four unidirectional carbon fiber-reinforced-polymer load-bearing parts 8*a*, 8*b*, 8*c*, 8*d* as shown in FIG. 2 covered with polyurethane coating 10. In case of four load-bearing parts 8*a*, 8*b*, 8*c*, 8*d* as shown in FIG. 2, the rope R is electrically modeled as four resistors. Preferred solution is to measure one rope R as a single resistance. In that way measuring arrangements are kept simple and the method is also more reliable, because the number of wires and connections is minimized. With this method simple and reliable solutions to short-circuit carbon fiber-reinforced-polymer load-bearing parts 8*a*, 8*b*, 8*c*, 8*d*, and to connect the measuring wires to the rope R, preferably by self-tapping screws screwed between the load-bearing parts 8*a*, 8*b*, 8*c*, 8*d* in such a way, that the screw acts as an electrically conductive path between adjacent load-bearing parts 8*a*, 8*b*, 8*c*, 8*d*, are used. At the counterweight end R" of said rope R, preferably three screws are used to short-circuit all of the strands. At the car end R' of said rope R, preferably two outermost load-bearing parts are connected together, and measuring wires are inserted under these two screws with a split ring connector. With this arrangement, all carbon fiber-reinforced-polymer load-bearing parts 8*a*, 8*b*, 8*c*, 8*d* are monitored and the whole rope is seen as a single resistor.

Figure 3:
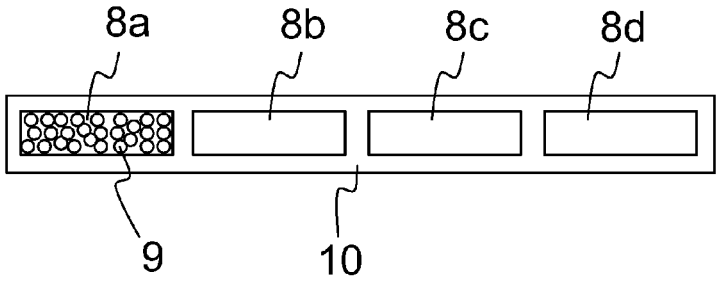
FIG. 3 illustrates a schematic view of a cross section of an embodiment of an elevator rope for which method steps of the invention can be performed.

FIG. 3 illustrates a preferred embodiment of a rope R cross section as described in connection with one of FIGS. 1 and 2 used as a suspension and/or transmission rope R of an elevator, particularly a passenger elevator. In the use according to the invention, at least one rope R, but preferably a number of ropes R is constructed such that the width of the rope is larger than its thickness in a transverse direction of the rope R and fitted to support and move an elevator car, said rope R comprising a load-bearing part 8*a*, 8*b*, 8*c*, 8*d* made of composite material, which composite material comprises reinforcing fibers, preferably unidirectional carbon fibers, in a polymer matrix. The suspension and/or transmission rope R is most preferably secured by one end to the elevator car 1 and by the other end to a counterweight CW, but it is applicable for use in elevators without counterweight as well. Although the figures only show elevators with a 1:1 suspension and/or transmission ratio, the rope R described is also applicable for use as a suspension and/or transmission rope R in an elevator with a 1:2 suspension ratio. The rope R is particularly well suited for use as a suspension and/or transmission rope R in an elevator having a large suspension height, preferably an elevator having a suspension height of over 100 meters. The rope R defined can also be used to implement a new elevator without a compensating rope C, or to convert an old elevator into one without a compensating rope C. The rope R is well applicable for use in an elevator having a suspension height of over 30 meters and implemented without a compensating rope C. Implemented without a compensating rope C means that the counterweight CW and elevator car 1 are not connected by a compensating rope C. Still, even though there is no such specific compensating rope C, it is possible that a travelling cable T attached to the elevator car 1 and especially arranged to be hanging between the elevator shaft and elevator car may participate in the compensation of the imbalance of the car rope masses. In the case of an elevator without a compensating rope C, it is advantageous to provide the counterweight with means arranged to engage the counterweight guide rails in a counterweight bounce situation, which bounce situation can be detected by bounce monitoring means, e.g. from a decrease in the tension of the rope supporting the counterweight CW.

It is obvious to a person skilled in the art that the invention is not exclusively limited to the embodiments described above, in which the invention has been described by way of example, but that many variations and different embodiments of the invention are possible within the scope of the inventive concept defined in the claims presented below. Thus it is obvious that the ropes R described may be provided with a cogged surface or some other type of patterned surface to produce a positive contact with the traction sheave 6. It is also obvious that the rectangular composite load-bearing parts 8*a*, 8*b*, 8*c*, 8*d* electrically modeled as resistors may comprise edges more starkly rounded than those illustrated or edges not rounded at all. Similarly, the polymer layer 10 of the ropes R may comprise edges/corners more starkly rounded than those illustrated or edges/corners not rounded at all. It is likewise obvious that the load-bearing part/parts 8*a*, 8*b*, 8*c*, 8*d* in the embodiments in FIGS. 2 and 3 can be arranged to cover most of the cross-section of the rope R. In this case, the sheath-like polymer layer 10 surrounding the load-bearing part/parts 8*a*, 8*b*, 8*c*, 8*d*, is made thinner as compared to the thickness of the load-bearing part 8*a*, 8*b*, 8*c*, 8*d*, in the thickness-wise direction of the rope R. It is likewise obvious that, in conjunction with the solutions represented by FIGS. 2 and 3, it is possible to use belts of other types than those presented. It is likewise obvious that both carbon fiber and glass fiber can be used in the same composite part if necessary. It is likewise obvious that the thickness of the polymer 10 layer may be different from that described. It is likewise obvious that the shear-resistant part could be used as an additional component with any other rope structure showed in this application. It is likewise obvious that the matrix polymer in which the reinforcing fibers 9 are distributed may comprise—mixed in the basic matrix polymer, such as e.g. epoxy-auxiliary materials, such as e.g. reinforcements, fillers, colors, fire retardants, stabilizers or corresponding agents. It is likewise obvious that, although the polymer matrix preferably does not consist of elastomer, the invention can also be utilized using an elastomer matrix. It is also obvious that the fibers 9 need not necessarily be round in cross-section, but they may have some other cross-sectional shape. It is further obvious that auxiliary materials, such as e.g. reinforcements, fillers, colors, fire retardants, stabilizers or corresponding agents, may be mixed in the basic polymer of the layer 10, e.g. in polyurethane. It is likewise obvious that the invention can also be applied in elevators designed for hoisting heights other than those considered above.

It is to be understood that the above description and the accompanying figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A method in rope condition monitoring of an elevator, in which method at least the following steps are performed:

electrical resistance between a first point and a second point of elevator suspension and/or transmission ropes is measured first time, and thereafter a threshold value is determined based on the measurement, and thereafter the elevator is used for transporting passengers and/or goods, and thereafter electrical resistance between the first point and the second point of said suspension and/or transmission ropes is measured second time, and thereafter results of said second time measurement are compared with said threshold value, and if said second time measurement meets said threshold value, predetermined actions are carried out, wherein said first point and second point are points of a non-metallic load bearing part of the suspension and/or transmission rope, or points of several electrically connected non-metallic load bearing parts of the suspension and/or transmission ropes.

2. The method according to claim 1, wherein electrical resistance between the first point and the second point of said suspension and/or transmission ropes is measured first time before the elevator is taken into use for transporting passengers and/or goods.

3. The method according to claim 1, wherein electrical resistance between the first point and the second point of said suspension and/or transmission ropes is measured first time during elevator installation.

4. The method according to claim 1, wherein the elevator car is suspended on said ropes while said first time and said second time measurements are performed on said ropes.

5. The method according to claim 1, wherein said first point and second point are points of load bearing parts of said suspension and/or transmission ropes made of fiber-reinforced polymer matrix composite material, such as carbon fiber-reinforced polymer matrix composite, preferably unidirectional carbon fiber-reinforced polymer matrix composite.

6. The method according to claim 1, wherein if said second time measurement value meets said threshold value between a first point and a second point of elevator suspension and/or transmission ropes, an error signal is given.

7. The method according to claim 1, wherein rope identification code and error level indication are shown for each rope on the LED or LCD display of a rope condition monitoring device if said error signal is given.

8. The method according to claim 1, wherein said error signals are routed to the elevator controller so that the elevator operation is altered or the elevator is taken out of service if said error signal is given.

9. The method according to claim 1, wherein the rope condition monitoring means monitors the status of each rope, said threshold value and said measurement values at predefined time intervals, preferably once per second.

10. An arrangement in rope condition monitoring of an elevator, which elevator comprises a hoistway, at least one elevator unit movable in the hoistway, including at least an elevator car, lifting means comprising a lifting device, one or more suspension and/or transmission ropes, each said rope comprising one or more load bearing parts connected at least to one elevator unit, rope condition monitoring means, in which arrangement rope condition monitoring means are arranged to perform the following steps:

electrical resistance between a first point and a second point of elevator suspension and/or transmission ropes is measured first time, and thereafter a threshold value is determined based on the measurement, and thereafter the elevator is used for transporting passengers and/or goods, and thereafter electrical resistance between the first point and the second point of said suspension and/or transmission ropes is measured second time, and thereafter results of said second time measurement are compared with said threshold value, and if said second time measurement meets said threshold value, predetermined actions are carried out, wherein said first point and second point are points of a non-metallic load bearing part of the suspension and/or transmission rope, or points of several electrically connected non-metallic load bearing parts of the suspension and/or transmission ropes.

11. The arrangement according to claim 10, wherein rope condition monitoring means is used to measure electrical resistance between said first point and said second point of said suspension and/or transmission ropes first time before the elevator is taken into use for transporting passengers and/or goods.

12. The arrangement according to claim 10, wherein rope condition monitoring means is used to measure electrical resistance between said first point and said second point of said suspension and/or transmission ropes first time during elevator installation.

13. The arrangement according to claim 10, wherein the elevator car is suspended on said ropes while said first time and said second time measurements are performed on said ropes.

14. The arrangement according to claim 10, wherein said first point and said second point are points of load bearing parts of said suspension and/or transmission ropes made of fiber-reinforced polymer matrix composite material, such as carbon fiber-reinforced polymer matrix composite, preferably unidirectional carbon fiber-reinforced polymer matrix composite.

15. The arrangement according to claim 10, wherein if said second time measurement value meets said threshold value between a first point and a second point of elevator suspension and/or transmission ropes, an error signal is given by said rope condition monitoring means.

16. The arrangement according to claim 10, wherein said rope condition monitoring means comprises a rope condition monitoring device and that rope identification code and error level indication are shown for each rope on the LED or LCD display of said rope condition monitoring device if said error signal is given.

17. The arrangement according to claim 10, wherein said error signals from said rope condition monitoring means are routed to the elevator controller so that the elevator operation is altered or the elevator is taken out of service if said error signal is given.

18. The arrangement according to claim 10, wherein said rope condition monitoring means comprises a rope condition monitoring device that monitors the status of each rope, said threshold value and said measurement values at predefined time intervals, preferably once per second.

19. The method according to claim 2, wherein electrical resistance between the first point and the second point of said suspension and/or transmission ropes is measured first time during elevator installation.

20. The method according to claim 2, wherein the elevator car is suspended on said ropes while said first time and said second time measurements are performed on said ropes.

* * * * *